US007708514B2

(12) United States Patent
Benedict et al.

(10) Patent No.: US 7,708,514 B2
(45) Date of Patent: May 4, 2010

(54) AUTOMATED SHIPBOARD MATERIAL HANDLING AND STORAGE SYSTEM

(75) Inventors: Charles E. Benedict, Tallahassee, FL (US); Brian G. Pfeifer, Tallahassee, FL (US); Christian A. Yates, Tallahassee, FL (US); Scott K. Bladen, Bristol, FL (US)

(73) Assignee: BEC Companies, Inc., Tallahassee, FL (US)

( * ) Notice: Subject to any disclaimer, the term of this patent is extended or adjusted under 35 U.S.C. 154(b) by 339 days.

(21) Appl. No.: 10/813,228

(22) Filed: Mar. 31, 2004

(65) Prior Publication Data

US 2005/0220573 A1 Oct. 6, 2005

(51) Int. Cl.
*B63B 27/00* (2006.01)
*B61B 3/00* (2006.01)
*B61C 11/00* (2006.01)

(52) U.S. Cl. ..... 414/142.6; 414/140.3; 414/282; 414/626; 414/236; 104/98; 105/77

(58) Field of Classification Search ..... None
See application file for complete search history.

(56) References Cited

U.S. PATENT DOCUMENTS

| | | | | |
|---|---|---|---|---|
| 2,440,307 | A | 4/1948 | Smith | |
| 2,963,310 | A | 12/1960 | Abolins | |
| 3,220,571 | A | 11/1965 | Kummerman | |
| 3,252,603 | A * | 5/1966 | Davis | 198/346.3 |
| 3,498,477 | A * | 3/1970 | Sommer | 414/142.6 |
| 3,513,999 | A * | 5/1970 | Slater et al. | 414/460 |
| 3,558,176 | A | 1/1971 | Fathauer et al. | |
| 3,604,743 | A | 9/1971 | Kinkopf | |
| 3,687,309 | A | 8/1972 | Macrander | |
| 4,043,285 | A | 8/1977 | Nordstrom | |
| 4,158,416 | A * | 6/1979 | Podesta | 414/140.1 |
| 4,172,685 | A | 10/1979 | Nabeshima et al. | |
| 4,666,356 | A | 5/1987 | Newbury | |
| 4,973,219 | A * | 11/1990 | Brickner et al. | 414/792.9 |
| 5,314,262 | A | 5/1994 | Meisinger et al. | |
| 5,354,112 | A | 10/1994 | Hara et al. | |
| 5,540,532 | A | 7/1996 | Carder et al. | |
| 5,560,663 | A | 10/1996 | Hara et al. | |
| 5,769,589 | A | 6/1998 | Lubbers | |

(Continued)

FOREIGN PATENT DOCUMENTS

DE 3103162 A1 * 8/1982

(Continued)

*Primary Examiner*—Gregory W Adams
(74) *Attorney, Agent, or Firm*—Dowell & Dowell PC

(57) ABSTRACT

A system and method for automated handling, transferring and storing conventional cargo storage containers on a cargo ship wherein the containers are stored in a multi-tier cell system and are manipulated by powered transfer units which are selectively moveable along an intersecting overhead track system such that containers may be simultaneously retrieved from, moved or placed within any of the cells of the ship. The transfer units are equipped both with hoists, which control spreader beams which are selectively secured to the cargo containers, and guide stabilizers, which prevent undesirable movement of the cargo containers when they are elevated above the cell structures such that the containers may be manipulated even during rough sea conditions such that the system is essentially continuously operable as a floating supply distribution system.

21 Claims, 9 Drawing Sheets

U.S. PATENT DOCUMENTS 5,915,906 A * 6/1999 Lucking et al. ..... 414/142.8
6,161,887 A * 12/2000 Shiota et al. ..... 294/81.2
6,220,173 B1 * 4/2001 Sauerwein ..... 104/130.01
6,572,319 B1 6/2003 Simmons, III et al.

FOREIGN PATENT DOCUMENTS

EP 0365086 10/1989
JP 60093006 A * 5/1985
JP 61114905 6/1986
JP 07172317 A * 7/1995

* cited by examiner

AUTOMATED SHIPBOARD MATERIAL HANDLING AND STORAGE SYSTEM

BACKGROUND OF THE INVENTION

1. Field of the Invention

This invention is generally directed to methods and devices utilized with container ships for loading and discharging standardized cargo shipping containers and more particularly to an automated multi-directional material handling system which may be used to selectively retrieve and discharge containers while a ship is at sea.

2. Brief Description of the Related Art

The most efficient and economical manner of shipping goods over waterways is the use of standardized cargo containers. The containers are designated in standard sizes which are generally twenty or forty feet in length. The containers are specifically designed so that they may be loaded into the holds and on the decks of ocean going vessels and off loaded from the vessels at a port by use of either on-board or on-shore cranes which place the containers directly onto land transport vehicles including railway cars and trucks. Container ships are specialized vessels which are specifically designed to maximize the storage capacity of international storage and shipping containers. Conventional container ships include one or more hold areas extending from the bow to the stern of the ship with each hold area being divided into a plurality of vertically tiered cells. The cells are defined by vertical steel beams which act as guides for the corners of the containers such that the containers may be stacked one upon another within each cell. Typical cells may retain as many as six or seven stacked containers.

With conventional container ships, the cells are covered by hatch covers or plate which are removed in order to allow a crane to access the uppermost container in each cell. Typically, a container ship will include one or a plurality of either fixed or mobile bridge cranes which have hoists for selectively elevating the containers from the cells and for lowering the containers into the cells. When fixed cranes are provided sufficient cranes must be positioned at various areas spaced along the deck in order to allow access to each cell. The use of overhead bridge cranes permits a single crane to be moved on parallel guide rails. The bridge cranes, are moveable laterally from side to side along the bridge structure such that the cranes are moveable in a horizontal plane.

There are several drawbacks with respect to current container ship load handling or transfer systems. Utilizing conventional systems it is not possible to easily retrieve a specified container which may be located at a bottom of a cell without requiring the removal and temporary placement of other containers along the deck of the ship. During rough sea conditions, such retrieval is not possible. Further, the manner in which the containers are loaded and off-loaded requires the ship to be stabilized and thus either be at a dock or be in an offshore area with quiet seas which permit loads to be elevated safely from the cell structures.

A further drawback of current container ship material handling systems which utilize bridge cranes for elevating and lowering the shipping containers is that only a single bridge crane can operate over a given area of the ship at any one time, thus slowing the rate at which containers can be retrieved or stowed relative to the cells of the container ship.

In view of the foregoing, it would be beneficial to have a material retrieval and handling system which could be used on container ships whereby selected containers may be rapidly and easily retrieved regardless of their position within a cell of the ship and regardless of sea conditions. Further, it would be beneficial to have such a system wherein multiple container handling units could operate over a common grid structure so that a plurality of containers may be simultaneously moved with respect to the cells of the various holds of the container ship.

SUMMARY OF THE INVENTION

The present invention is directed to an automated material retrieval handling and storage system for use in manipulating standardized cargo containers within cells of a container ship wherein the system includes a grid track structure which is securely mounted above the cells of the container ship and which defines intersecting and generally perpendicularly oriented tracks on which are guided container transfer units. Each transfer unit is mounted by a plurality of carriages which are mounted within the tracks such that the transfer units are suspended from the tracks and are moveable both from fore to aft and from port to starboard relative to the cells of a container ship. Each transfer unit includes hoists which are connected to a spreader beam structure which is formed as a frame for engaging and locking on to a standardized cargo container. In order to stabilize cargo containers as they are elevated above the cell structures toward the transfer units, each transfer unit includes an extendable stabilizer mechanism which prevents swinging of the container even under rough sea conditions as they are removed from the cells.

The transfer units are powered, in a preferred embodiment, by motors which power drive gear systems which are selectively engageable with fixed gear racks mounted to the grid track system. The drive motors have anti-backdrive features such that when they are not powered, with the gears in engagement with the racks mounted to the grid system, the motors act as locks to prevent movement of the transfer units.

The system is designed to provide a space above the upper tier of each cell which is large enough for the transfer units to maneuver while suspending a spreader beam therefrom such that the containers may be manipulated throughout the grid system and moved from one cell area to another beneath a raised deck of a ship. This not only enables movement of containers without placing the containers to the upper deck of the ship but also allows containers to be moved without having to remove the hatch covers above a cell in order to retrieve a specific cargo container from a predetermined area.

Using the system of the present invention, it is possible to utilize a single crane which may be in a fixed position along the deck of a container ship and move the cargo containers to specified discharge areas wherein one or more hatch covers may be removed while maintaining the other hatch covers closed during either loading or off-loading of the storage containers. The system thereby reduces the amount of effort and manual labor which is necessary to access the storage containers, permits movement of multiple containers within an area below the deck but above the cell structures such that the container may be interchangeably manipulated from space to space and further permits the area of the hold to be protected by being substantially covered by the removable hatch plates except in an area designated for loading and off-loading.

It is a primary object of the present invention to provide an automated material handling, retrieval and storage system for container ships which allows the ships to function as moveable supply sources such that supplies from containers may be manipulated while at sea, even during poor weather conditions, by providing a systems which enables cargo containers to be selectively retrieved and manipulated below deck for above deck transfer when and as necessary.

It is yet another object of the invention to provide a material handling system for use on container ships which facilitates the efficient maneuvering, loading and off-loading of standardized cargo containers wherein a plurality of transfer units move the containers simultaneously along a grid track system so that a plurality of containers may be moved simultaneously without interfering with one another.

It is a further object of the present invention to provide an automated material handling system for use on container ships wherein the cargo stowage cells of the ship may be placed in an unconventional orientation, such as an L-shaped configuration, which would not other wise be possible utilizing bridge crane structures which operate in a predetermined rectangular plan, as the grid structure of the present invention allows movement of transfer units throughout the total surface area of a hold of a ship regardless of its configuration.

It is also an object of the present invention to provide a material handling, retrieval and storage system for standardized international cargo containers which enables specific containers to be retrieved from any level of a multi-tiered cell structure of a hold without requiring that containers be elevated above the deck level thus making the system safer not only for the materials but also for personnel handling the cargo containers.

BRIEF DESCRIPTION OF THE DRAWINGS

A better understanding of the invention will be had with respect to the accompanying drawings wherein.

DESCRIPTION OF THE PREFERRED EMBODIMENT

Figure 1:
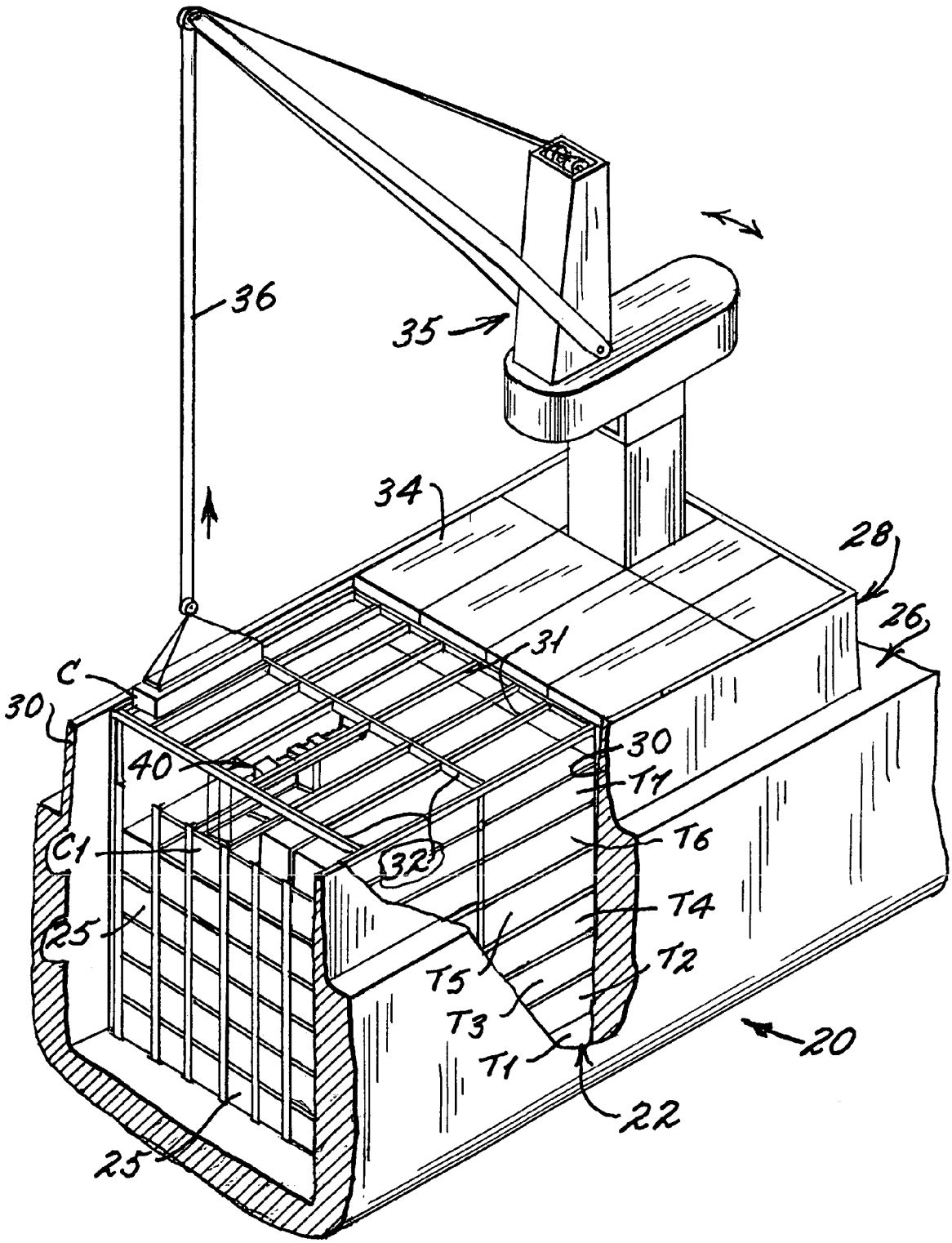
FIG. 1 is a perspective illustrational view, in cross section having portions broken away, of a hold of a cargo container ship showing hatch plates covering a number of cells at the base of a crane and wherein hatch plates have been removed from a plurality of cells in which cargo storage containers are selectively stowed.

With specific reference to FIG. 17 of the drawing figures, the system of the present invention will be described in association of a container ship 20. It should be noted that the system may be used in other non-shipping environments such as mini-warehouses, distribution warehouses, garages and the like. The container ship is shown in cross section at the central portion so as to illustrate four hold areas 21, 22, 23 and 24 each of which is divided into a plurality of vertically tiered cells 25. The cells are defined by vertically and horizontally extending steel beams which are generally of a size to allow a conventional standardized cargo container to be restrained within each cell in a conventional manner well know to those in the art. With the invention, however, the upper portion or upper tier of cells shown at T7, as opposed to being situated on the deck 26 of the vessel, are actually seated on top of each tier of cells within an enclosure 28 defined by steel plates which are secured to an enclosure which is formed as steel framing secured to the superstructure of the ship and which extends upwardly from the conventional deck a height sufficient to allow for at least a single tier of storage containers "C" to be stowed. Above that, a grid track system which is used to support vehicle transfer units in accordance with the teachings of the present invention is provided. The space above the normal cell height is shown generally at 30 in FIG. 17 and may be, for example, 16 feet in height.

With specific reference to FIG. 1, a partial cross sectional perspective view of hold 22 of the container ship 20 is shown in greater detail. The enclosure 28 is shown as being reinforced by a plurality of fore and aft extending steel beams 31 and starboard to port extending beams 32 each of which is constructed to coincide with the cells over which the enclosure 28 is positioned. This grid structure is sealed utilizing conventional hatch plates 34 which are removably mounted in a conventional manner to the structure. As further shown in FIG. 1 and in FIG. 18, there are seven storage tiers T1 through T7 in each cell 25 of the hold area and, further, there are shown, seven cells in width between the starboard and port side of the ships hull.

Figure 17:
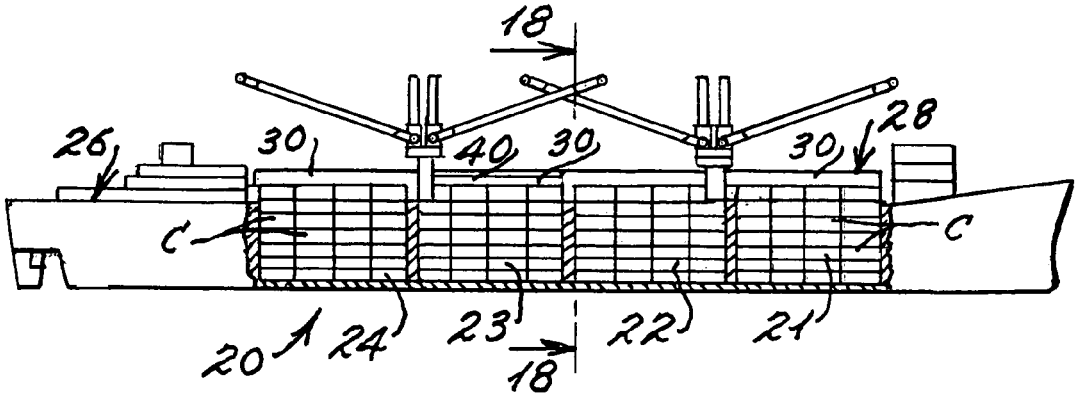
FIG. 17 is a cross sectional illustrational view of the system of the present invention shown in a container ship having four hold areas and showing one of the transfer units moveable along the grid system within the third hold area for purposes of illustrating an environment of the invention.
Figure 18:
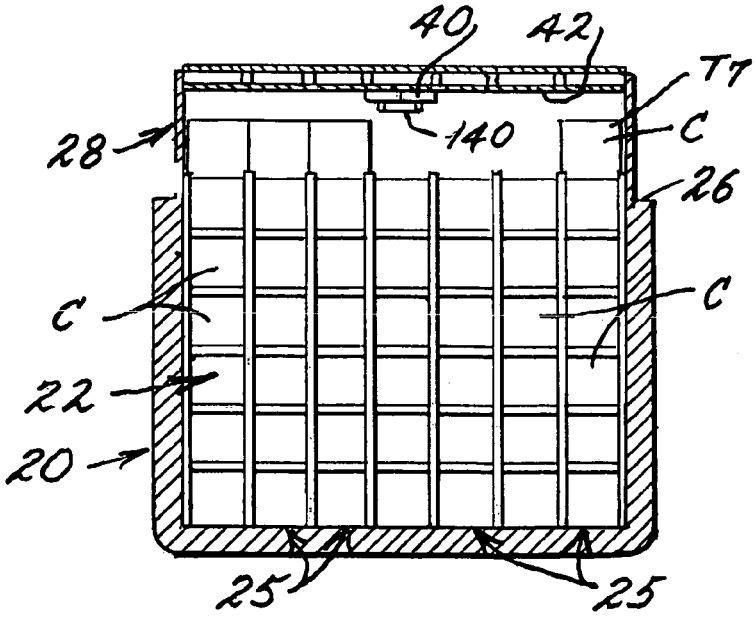
FIG. 18 is an enlarged cross sectional view taken along line 18-18 of FIG. 17.

The system of the present invention allows the first six tier levels to be completely filled with storage containers "C" as is illustrated in FIGS. 1 and 18, however, approximately half of the seventh tier "T7" of each of the cells are left vacant or empty upon the initial loading of the vessel in order to allow for storage containers to be shuffled within the seventh tier in order to retrieve containers from the lower tiers "T1-T6" of the vessel. Utilizing the invention, a container located on the sixth tier may be elevated and placed in the seventh tier of one of the cells and, in like manner, the underlying container in the fifth tier may also be raised and placed in an empty seventh tier of another cell. In this manner, access can be obtained to any of the containers within a cell without requiring that the containers be elevated out of the hold area of the ship. Once a desired container such as shown at C' in FIG. 1 is exposed, the container may be elevated by use of a ships crane 35 utilizing conventional hoist line equipment 36. In FIG. 17, four such cranes 35 are shown for purposes of facilitating the loading and off-loading of containers from the various holds of a cargo ship. As opposed to using the ship's crane 35 to elevated container C' from the cell, the container may be elevated by one of the transfer units, to be described hereinafter, and moved to an area for off-loading by the crane 35.

One of the benefits of the present material and article handling system is that the hatch plates 34 need not be removed from each of the tiered cell structures because the cargo containers "C" may be moved to any selected open cell area. Therefore, cargo containers which are stored in the cells beneath the hatch plates 34 shown at FIG. 1 can be moved to an opening by the transfer units which are used with the invention and which operates within the upper open area 30 of the enclosure 28 above the tiered cells. Thereafter, the cargo container C' may be raised by the crane. This means that, with the present invention, it is not necessary to remove all the hatch covers to obtain access to underlying cargo storage containers as the storage containers may be elevated to the open space 30 within the enclosure 28 and thereafter maneuvered to any predetermined area for retrieval by the ship's crane 35.

Figure 2:
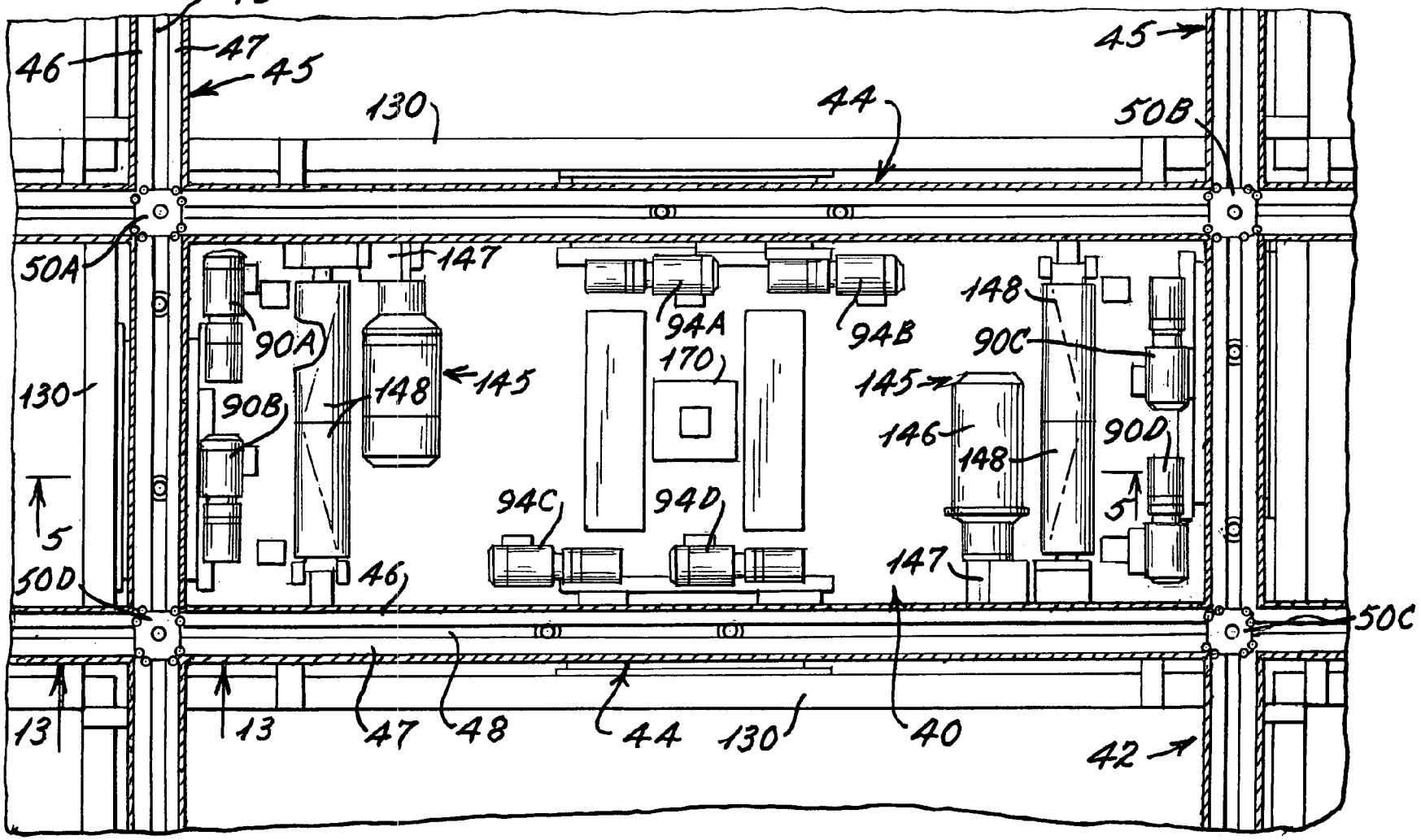
FIG. 2 is a top plan view of a section of the grid track system of the present invention which is mounted to a superstructure which supports the hatch covers of the container ship and which shows four carriages which suspend one of the transfer units of the present invention from the grid track system.

As previously described, the present invention utilizes powered transfer units 40 which are only roughly illustrated in FIGS. 1, 17 and 18 which are moveably supported on a grid track system 42, which system is illustrated in FIG. 2.

The grid track structure 42 includes a plurality of intersecting generally C-shaped steel tubing members 44 which are fixedly secured, such as by welding, bolting or other attachment means to the underside of each of the fore and aft extending structural girders or beams 31 which openly intersect with similar C-shaped hollow steel tubing members 45 which are fixedly mounted, such as by welding, to the underside of each of the port to starboard extending structural members or beams 32 of each of the cell structures of the invention. The grid system 42 is shown in FIG. 2 in cross section such that the upper or back wall of each of the hollow beams is not shown, however, lower flanges 46 and 47 of each beam are shown as being spaced from one another to define an open channel 48 for passage of pilot shafts associated with roller carriages which serve to mount the transfer units 40 to the grid system, as will be described in greater detail. The transfer unit 40 shown in top view in FIG. 2 is supported within the grid system by four separate carriages 50A, 50B, 50C and 50D.

With specific reference to FIGS. 13 through 16, one of the transport carriages 50A is shown in greater detail. The carriage is shown as including a plurality of ball rollers 51 which are designed to track on an upper surface 52 of each of the lower flanges 46 and 47 of one of the track segments 44 or 45. The track segment 45 is shown in the drawing Figures. The carriage includes a main body portion 53 which supports a central pilot shaft 54 which extends through the open slot 48 in the guide track. With specific reference to FIG. 14, each carriage includes opposite sets of guide rollers 56 and 57 which extend upwardly from the body 53 so as to engage opposing sidewalls 59 and 60 of the track 45. Each carriage also includes oppositely oriented guide rollers 61 and 62 provided on opposite sides of the body which are used to guide the carriage when moving along a perpendicular guide track 44. In this manner, and as shown at FIG. 2, when the transfer unit 40 reaches an intersection of the track segments 44 and 45, the direction of the transfer vehicle may change so that the transfer unit moves either fore and aft relative to the ship or athwartship from port to starboard or visa versa relative to the ship. The carriages will be guided by the sets of rollers 56, 57 and 61, 62 depending upon which track segment the transfer unit is traveling at a particular time.

Each carriage further includes a guide roller 65 mounted to the pilot shaft 54 so as to track between a pair of gear racks 66 and 67 which are welded or otherwise secured to the lower surface of each of the flanges 46 and 47 respectively of the guide track 45. Similar gear racks are provided in spaced relationship to the track segments 44. The guide rollers 65 engage the inner surfaces of the each of the guide racks to stabilize the movement of the carriage relative to the guide tracks 44 and 45 of the grid system 42. The shaft 54 extends down and is engaged within a mounting member 68 which is designed to be securely connected to the transfer unit 40 in order to support the transfer unit relative to the carriages, generally as shown at 68 in FIG. 3, at one of the corners of the transfer unit 40. The teeth of each gear rack 66 and 67 are bidirectional at each intersection.

Figure 16:
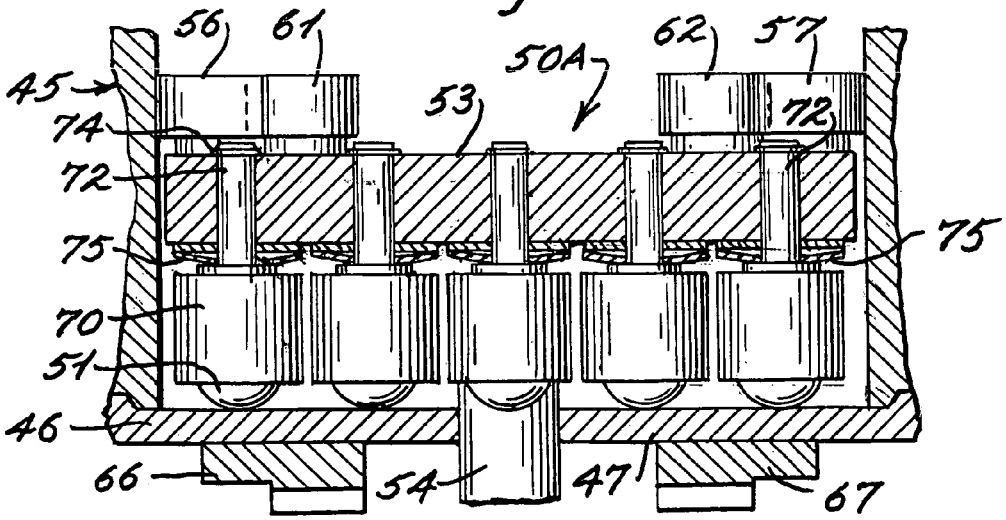
FIG. 16 is an enlarged view of the carriage member shown in FIG. 13.

With specific reference to FIG. 16, each carriage roller member 51 is mounted within a housing 70 mounted by a stub shaft 72 to the base 53 of the carriage. The stub shafts 72 are secured by snap rings 74 to the body 53. Disk springs 75 are shown as being provided between each roller ball housing 70 and a lower surface of the body 53 of the carriage to provide a shock absorbing effect for each of the roller assemblies.

Figure 3:
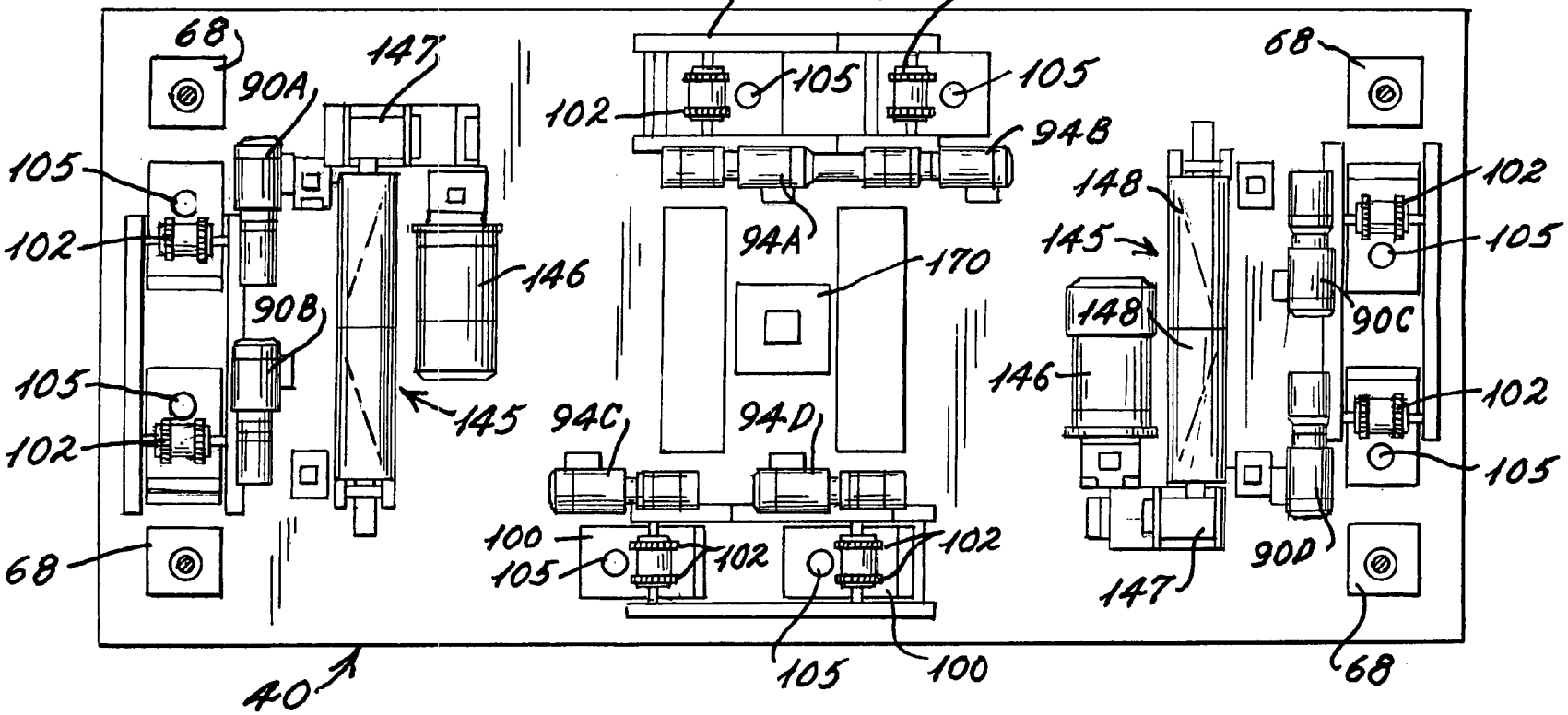
FIG. 3 is a top plan view of one of the transfer units of the present invention.

As described, each transfer unit 40 is supported by at least four carriages which are mounted generally adjacent the corners of the transfer unit as shown in FIG. 3.

With reference to FIGS. 2 through 12, one of the transfer units 40 of the present invention will be described in greater detail. It should be remembered that a plurality of transfer units will operate within the system of present invention. Because of the intersecting grid tracks of the system 42, the plurality of transfer units will move independently of one another moving cargo containers within the open area 30 above the top tier T7 of the cells within each hold with transfer units being able to maneuver about one another because of the intersecting grid system.

Each transfer unit 40 includes a main body 80 which is defined having upper and lower surfaces 81 and 82. Generally, the body is defined by a steel frame covered by steel sheet metal along the upper and side surfaces. Mounting brackets 83 are provided at each of the corners extending from the upper surface of the transfer unit and connect with the mounting member 68 associated with each carriage. The mountings members may be connected utilizing conventional bolts or may be connected by welding. In order to drive the transfer units relative to the grid track system 42, the present invention provides four separate motors 90A, 90B, 90C and 90D each of which drives pinion gears which are pivotally mounted as will be explained in greater detail so as to be selectively brought into meshed engagement with the spaced gear racks 66 and 67 mounted to the grid track segments 44 and 45. The motors 90A through 90D are specifically designed to provide power for moving the transfer unit 40 along the grid track segments 45 between starboard and port with respect to the container ship. Four additional motors 94A through 94D are provided for providing power to similar pinion drive gears associated therewith which are selectively moveable into engagement with the gear racks 66 and 67 secured to the grid track segments 44 so as to move the transfer unit fore and aft relative to the container ship. As the manner in which the motors 90A-D and 94A-D are used to power the drive pinions is the same, only one drive assembly associated with motor 90A will be described in greater detail and is shown in FIGS. 6-9. The motor 90A is fixedly mounted to a support frame 96 which is secured to the upper surface of the transfer unit.

Figure 6:
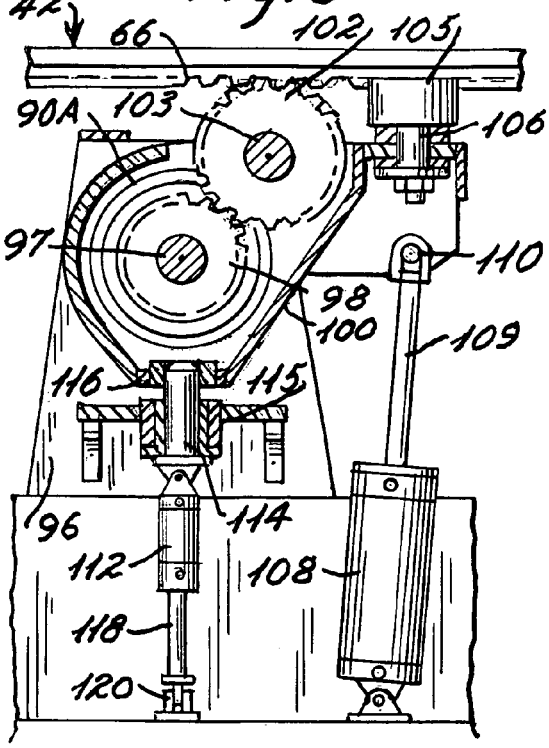
FIG. 6 is a cross sectional view of one of the drive motors and the drive gears of the transfer unit of the present invention engaging the gear rack associated with the grid system of the invention.

As shown in FIGS. 3 and 6, each of the motors 90 and 94 are mounted to similar brackets 96 which are secured to the upper surface of the transfer unit. Each motor has an output drive shaft 97 to which is fixedly secured a pair of spaced driving pinion gears 98 which are disposed within a pivot housing 100. A pair of driven gears 102 are mounted in spaced relationship to a stub shaft 103 which is secured to the housing 100. Teeth of the driven pinion gears 102 mesh with the teeth of the drive gears 98. In the position of the housing 100 shown in FIGS. 6 and 7, the driven pinion gears 102 are shown as being in driving engagement with respect to the gear racks 66 and 67 which extend along the grid track system.

Figure 7:
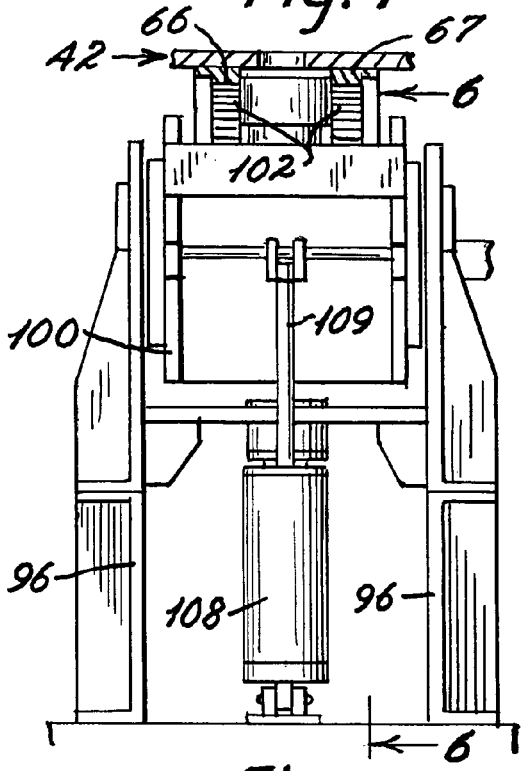
FIG. 7 is a front plan view of the drive motor and gear drive assembly of FIG. 6 in a driving position.
Figure 8:
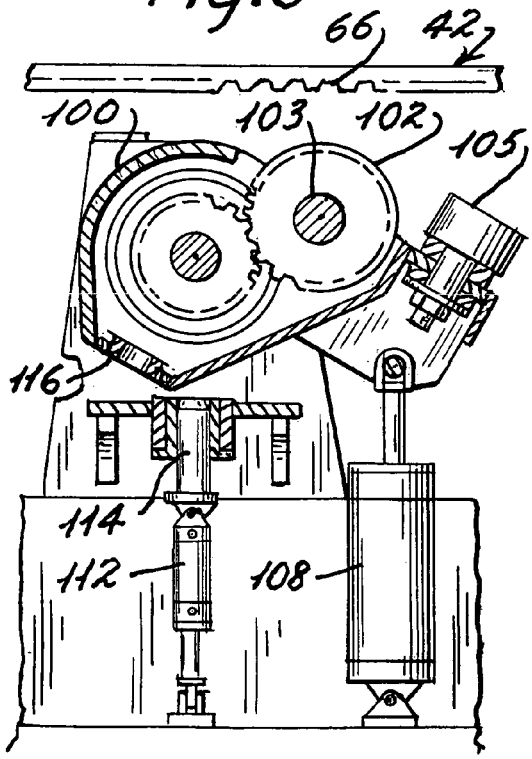
FIG. 8 is a view of the drive motor and drive gear arrangement of FIG. 6 shown in a disengaged position.
Figure 9:
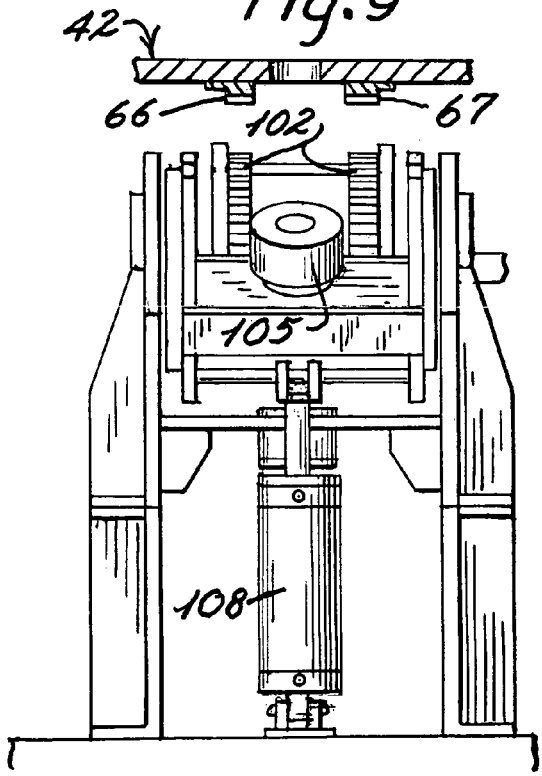
FIG. 9 is a front elevational view of the drive gear of FIG. 8.

To insure proper alignment of the driven gears 102 with the gear racks 66 and 67, the housing 100 also supports a guide wheel 105 mounted to a shaft 106. The guide wheel is of a size to cooperatively be seated between the gear racks 66 and 67 as shown in FIG. 7. When it is desired to disengage the motors and thus the driven gears 102 from the gear racks 66 and 67, a hydraulic or pneumatic cylinder 108 is activated to pivot the housing 101 to a retracted position, as shown in FIGS. 8 and 9. The cylinder 108 has a ram arm 109 pivotally connected at 110 to the housing 100.

To lock the housing 100 in a position to ensure that the driven gears 102 engage and are maintained in engagement with the gear racks 66 and 67, a second hydraulic or pneumatic cylinder 112 is provided which is connected at its base to a locking pin 114 which is moveable guided within a cylinder 115 which is mounted below the housing 100. In a position shown in FIGS. 8 and 9, the locking pin 114 is extended within a receiver 116 provided in a base of the housing 100 thereby preventing rotation of the housing and insuring engagement of the drive gears 98 with the driven gears 102. In the event of power failure, this pin remains in the locked position. The cylinder 112 is connected through ram arm 118 to a pivot attachment 120 along the upper surface of the transfer unit.

When it is desired to disengage the gears 102 from the gear racks 66 and 67, the locking pin 115 is withdrawn from the receiver 116 of the housing 100 thereby allowing the hydraulic or pneumatic cylinder 108 to pivot the housing 100 to the disengaged position for the driven gears 102 as shown in FIGS. 8 and 9.

As previously noted, the motors 90A, 90B, 90C and 90D are all connected to similar drive gear assemblies which function to move the transfer unit along the tracks or track segments 45 whereas the drive motors 90A, 90B, 90C and 90D include similar drive gear arrangements which are used to power or move the transfer unit along the guide track segments 44.

Although power to the motors 90 and 94 may be provided by onboard batteries carried by each transfer unit, AC power may also be supplied to the transfer units through an inductive power transfer raceway system 130. The raceway extends parallel and outside each of the guide tracks of the grid system of the present invention. Power is supplied in a conventional manner to the raceway and the raceway can be insulated both electrically and from atmospheric conditions. Similar systems are currently used on bridge cranes used on container ships. One such raceway system is referred to as an "Inductive Power Transfer" (IPT) provided by Wampfler, Inc. of Florence, Ky. To receive power, each motor includes an electrical collector shoe 132 which extends outwardly in opposing relationship with respect to the conductor raceway system as is shown in FIG. 4 of the drawings.

Figure 4:
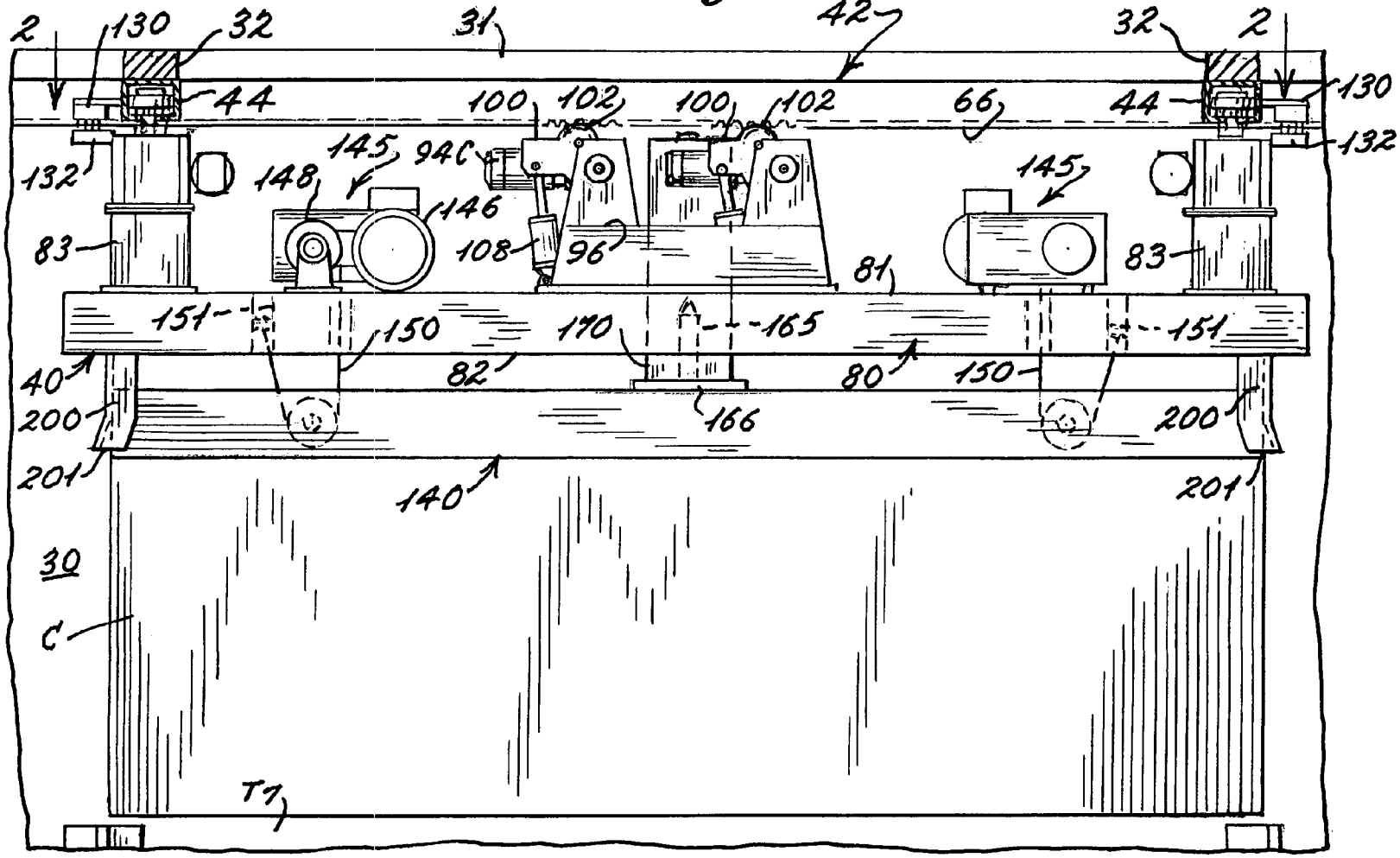
FIG. 4 is a side view of the transfer unit shown in FIG. 2 and showing a cargo container secured to a spreader frame which is suspended from the hoist system of the transfer unit of the present invention.
Figure 5:
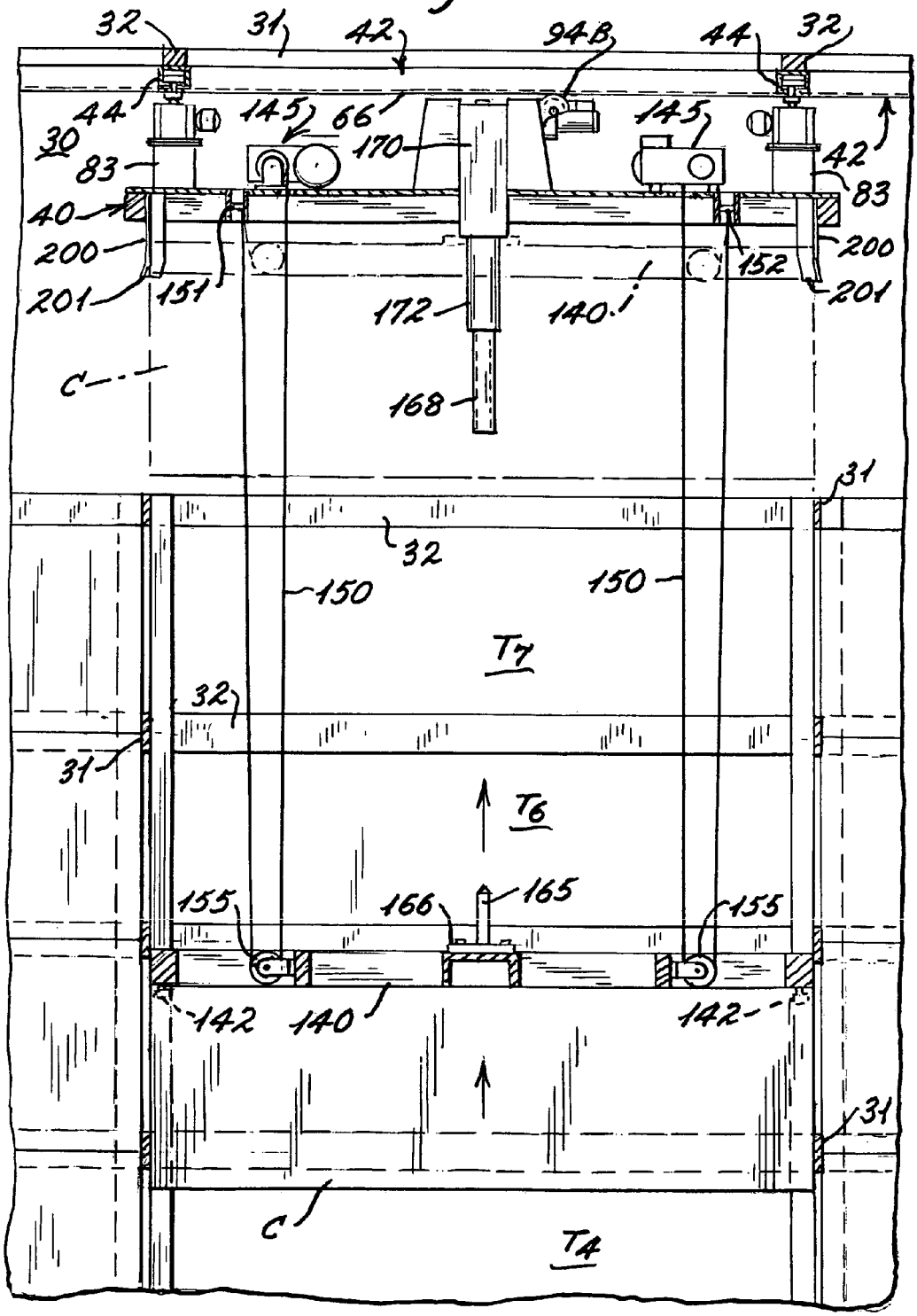
FIG. 5 is a view similar to FIG. 4, on a smaller scale, showing the transfer unit elevating a cargo container from a lower tier of a cell of the cargo hold of the container ship.

With specific reference to FIGS. 4 and 5, each of the transfer units of the present invention supports a generally conventional spreader beam 140 which has a frame type structure of a size to compatibly engage the shipping containers "C". Each of the spreader beams includes lock mechanisms illustrated at 142 in drawing FIG. 5 which are positioned at the four corners of the spreader beam and engage within lock boxes which are provided as a standard feature in all international shipping containers. As a frame is lowered into contact with the upper surface of the container "C", the locks are activated and they rotate within the lock boxes to secure the spreader beam to the container. Thereafter, the containers are raised utilizing a hoist assembly carried by each of the transfer units 40. Mounted to the upper surface of each of the transfer units are a pair of hoist assemblies 145 each of which is driven by a motor 146 which receives power from the raceway 130 as previously described. As an alternative, onboard batteries may also be provided to supply power to the motors 146. The motors are connected through gearboxes 147 to pairs of winding drums 148 about which cables 150 are selectively wound. The remote end of each cable is secured at 151 to the frame of the transfer unit. Each of the cables extends about pulleys 155, four which are provided on the spreader beam.

As shown in FIG. 5, each of the tiered cells is defined at the corners by structural beams 160 and 161 which intersect at approximately 90° and form four guide channels for guiding the container "C" and the spreader beam 140 as they are raised or lowered with respect to the cells. In the present invention, however, means are provided for securing the spreader beam and the container so that they do not sway as they are lifted into the open space 30 above the upper tier T7 of the cells. This is an important feature of the transfer units of the present invention as it allows the transfer units to control movement of the cargo containers even during rough seas thereby allowing the containers to be manipulated when it is not possible to do so with conventional material handling systems currently used on container ships.

As shown in FIG. 5, each of the spreader beams include a central guide pin or probe 165 which is mounted to a base 166 secured to the spreader beam frame. As the spreader beam is raised, the pin engages within an extensible guide tube 168 which is telescopically mounted with respect to a support housing 170 by way of an intermediate tube 172. The housing 170 is mounted by supports 174 to the upper surface of the transfer unit 40.

Figure 10:
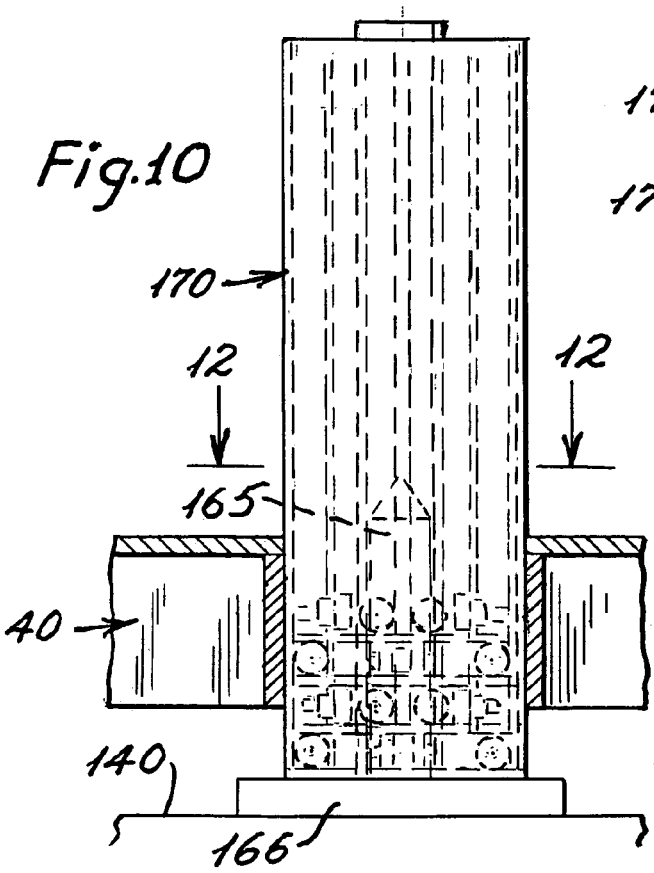
FIG. 10. is an enlarged view of the stabilizer assembly associated with the transfer units of the present invention shown in a fully raised position.
Figure 11:
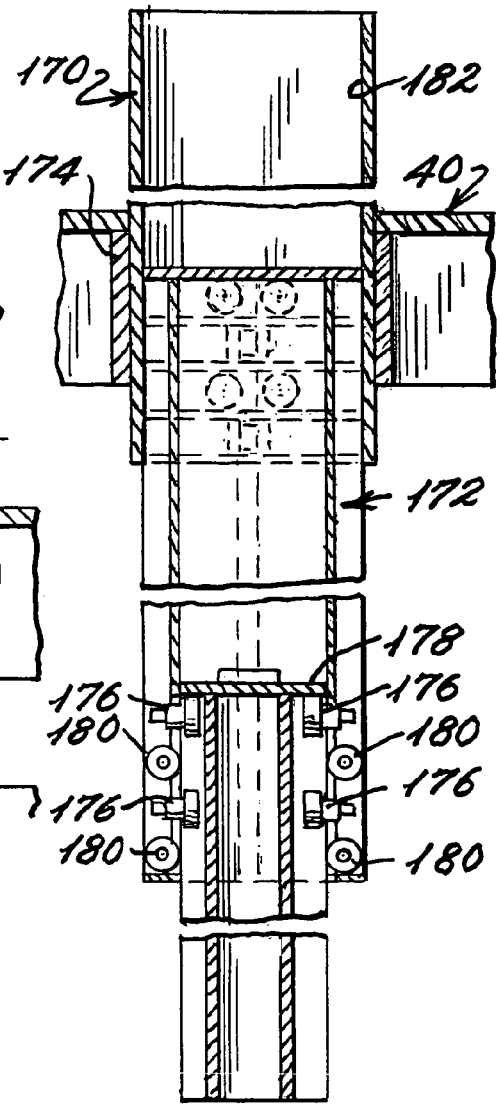
FIG. 11 is a cross sectional view of the stabilizer assembly of FIG. 10 shown in an extended position ready to mate with a probe extending from the spreader frame of a transfer unit of the present invention.
Figure 12:
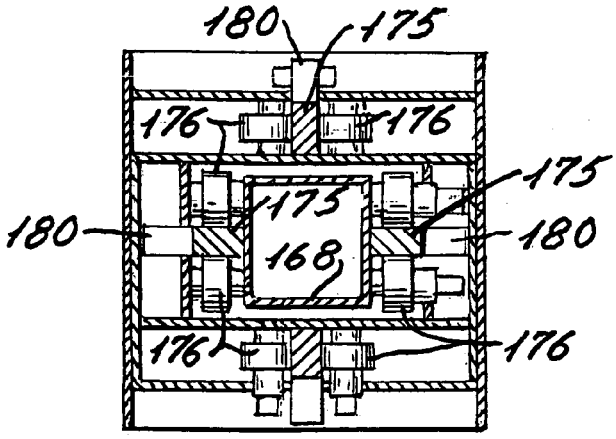
FIG. 12 is a cross sectional view taken along line 12-12 of FIG. 10.
Figure 12:
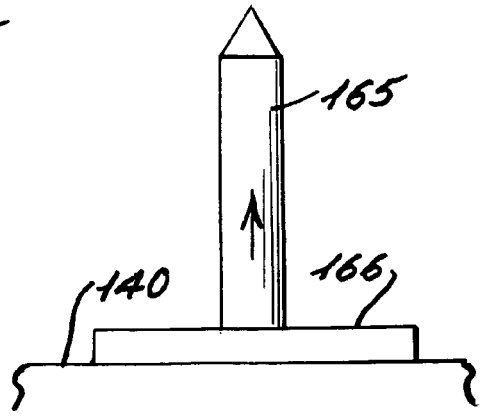
Figure 13:
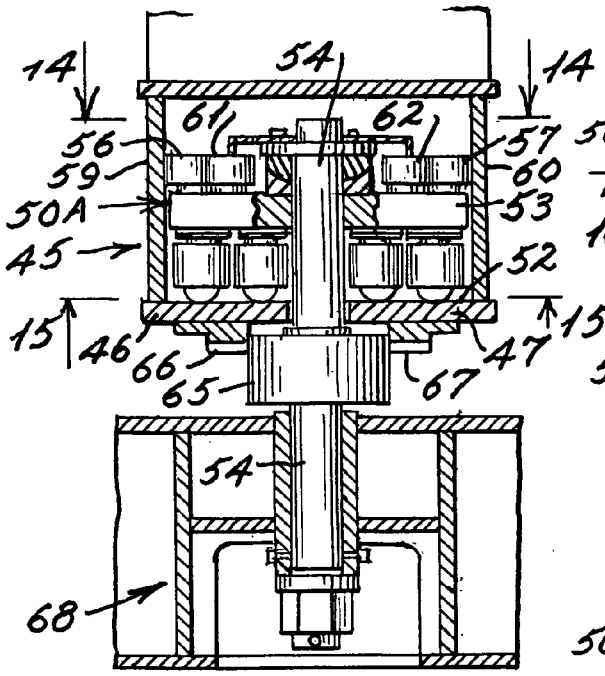
FIG. 13 is a cross sectional view showing one of the carriage assemblies for mounting a transfer unit to one of the grid tracks of the invention.
Figure 14:
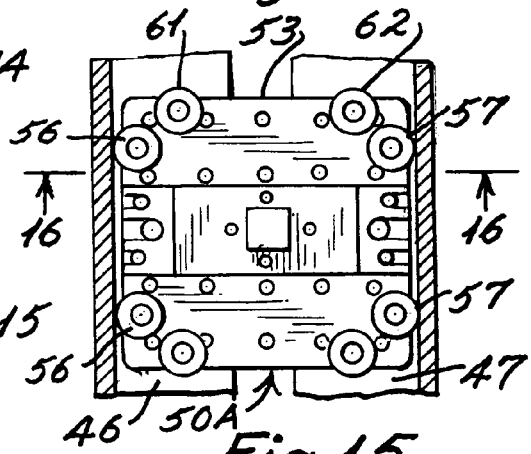
FIG. 14 is a cross sectional view taken along line 14-14 of FIG. 13.
Figure 15:
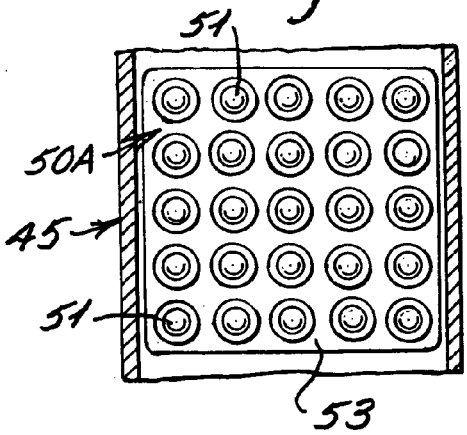
FIG. 15 is a view taken along line 15-15 of FIG. 13.

The container guide assembly is shown in more detail in FIGS. 10 through 12. As shown, the guide tube 168 is generally square in configuration so as to cooperatively receive the pin which is also generally square in cross sectional configuration. Because of the cooperating engagement of the pin within the tube 168, it is not possible for the spreader beam to rotate relative to the transfer unit when the spreader beam and the cargo container "C" are elevated into the open area 30 above the upper tier level T7 of the cells to control the spreader beam when a container is not attached to the spreader beam.

The guide tube 168 further includes a pair of outwardly extending guide flanges 175 which are guided by spaced rollers 176 mounted to the intermediate tube 172. As shown in FIG. 12, the lower extent of the guide tube 168 is limited by the upper set of rollers 176 as an upper flange 178 of the tube engages the upper rollers 176 in a fully extended position.

As the spreader beam is raised utilizing the hoist assemblies of the present application, when the pin 176 engages within the tube 168, the tube will begin to elevate within the intermediate guide tube 172. Supplemental rollers 180 are also mounted to the intermediate tube 172 and are oriented to engage the outer edge of each of the flanges 175 of the guide tube 168. These rollers also engage the inner surface 182 of the primary support housing 170 of the guide assembly as the guide tube 168 and intermediate tube 172 are elevated as the container is raised by the hoist assemblies associated with the transfer unit. The guide assembly is shown in its fully elevated position in FIG. 10 wherein the telescoping guide tube 168 and the intermediate guide tube 172 are fully received with the primary support housing 170. Although not shown in the drawings, any appropriate locking mechanism may also be used to secure the guide assembly in its fully raised position as shown in FIG. 10.

To further guide and control the movement of the container "C" relative to the transfer unit when in a fully raised position as illustrated in dotted line in FIG. 5, four corner guide arms 200 which are slightly flared outwardly at their lower edges 201 are provided. Each guide arm has two guide wall portions which intersect at approximately 90° with respect to one another so as to cooperatively engage the corners of the spreader beam 140 which is secured to a container as is illustrated in the drawing figure when the container is raised relative to the transfer unit as is illustrated in FIG. 4.

As previously described, in accordance with the teachings of the invention, plural transfer units may operate within the grid track system of the present invention thereby enabling containers to be shuffled simultaneously within the open area 30 defined above the upper tier T7 level of the cells within a hold.

With the present invention, a number of spaces in the T7 level of each hold are vacant when the container ship is fully loaded. This permits containers from lower tier levels (T1-T6) to be moved into the open spaces so as to retrieve containers at lower tier levels. After a desired container is retrieved utilizing a transfer unit of the present invention, the containers which have been moved can be replaced within a particular cell from which they were originally taken.

When a transfer unit is to be moved, the drive pinion associated either with the motors 90 which are used to drive the drive gears to move the transfer unit laterally between the starboard and port are operated or the motors 94 which are used to power the transfer unit between the fore and aft direction are operated. At each intersection a change in direction may be made as is illustrated in FIG. 2. When a change in direction is desired, the transfer unit automatically stops at the intersection and a change is made in the drive gears which are powered. The arrangement of the grid system is such that the transfer unit is centered over each cell at each intersection of the grid system to thereby facilitate the extraction or insertion of containers out of or into the cell. When a change of direction is required, the driven pinions for the new direction engage the rack gear teeth at which time the driven pinions that were driving the transfer unit disengage from the rack gear teeth. This provides constant control of the transfer unit and insures that it is under direct drive in which ever direction it is traveling at all times.

Whenever the transfer unit is extraction or inserting a container out of or into a cell, both sets of driven pinions powered by the motors 90 and 94 are set to engage the rack gear teeth in a stopped mode. This securely locks the transfer unit in position.

By way of example, it is contemplated that the motors used to power the drive gears are anti-backdrive motors and will enable the transfer units to operate at approximately 60 feet per minute when fully loaded and at approximately 90 feet per minute with no load. The hoist motors may include two 75 horse power AC motors which obtain their power as previously described from the power raceway. The hoists will lift fully loaded containers at a rate of approximately 75 feet per minute and may operate at up to 112 feet per minute with no load.

The system of the present invention may be fully automated and interfaced with an inventory control system so that each transfer unit is directed to a given cell and to a given container location within the hold by multiplexing a command signal from the inventory control system through the power raceway grid wiring. Digital input from the drive motor rotations and counting rack teeth and registration at digitized check points along the grid system or at each cell location will provide guidance for the transfer units within the system. The hoist motors will also have digitized features for determining the exact elevation and relationship of the transfer beam to each transfer unit when raising and lowering a container.

Utilizing such a system, a designated container may be automatically located and containers above the designated container may be moved appropriately and, thereafter, relocated once the designated container has been retrieved utilizing the transfer units and their hoist mechanisms.

Once a designated container is located it may selectively elevated and positioned for retrieval from the hold utilizing the ships crane as previously described. Loading of the hold can also be fully automatic with each container being placed at a predetermined location within the hold.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

The invention claimed is:

1. An automated material handling and storage system for storage and shipping containers, the system comprising, a structure defining a plurality of vertical cells, each cell having a plurality of tier levels and being of a size to cooperatively receive a storage and shipping container at each tier level, a grid track system mounted in spaced relationship above said plurality of vertical cells and having a plurality of first pairs of parallel tracks extending transversely with respect to and intersecting with a plurality of second pairs of parallel tracks in an X-Y pattern and which first and second tracks define openings at each intersection thereof, at least one transfer unit moveably mounted in suspended relationship from the said grid track system, said at least one transfer unit including a plurality of carriage means for suspending said at least one transfer unit from said grid track system so as to be selectively moveable along a pair of said plurality of first pairs of parallel tracks for movement in a first direction directly above each of said plurality of said vertical cells and being selectively moveable along a pair of said plurality of second pairs of parallel tracks for movement in a second direction which is transverse to the first direction directly above each of said plurality of vertical cells, an arrangement of said grid track system being such that said at least one transfer unit is centered over a vertical cell when adjacent the intersections of said pairs of first and second parallel tracks and such that said at least one transfer unit is centered by being movable in either said first or second direction, said at least one transfer unit including drive means for moving said at least one transfer unit along said grid track system so as to be moveable in a horizontal plane in both forward to back and side to side motions within the horizontal plane directly above each of said plurality of vertical cells, a spreader beam, hoist means carried by said at least one transfer unit for raising and lowering said spreader beam, said spreader beam being of a size to cooperatively engage a storage and shipping container within one of said cells, at least one guide member extending between said spreader beam and said at least one transfer unit to stabilize said spreader beam with respect to said transfer unit to thereby control movement of a storage and shipping container carried by said spreader beam when the storage and shipping container is elevated above said plurality of cells, and means for providing power to said drive means of said at least one transfer unit.

2. The automated material handling and storage system of claim 1 wherein each carriage assembly includes a plurality of roller elements mounted to a body, each body being of a size to be cooperatively received within an open channel defined by each of said first and second tracks of said grid track system, each of said carriages including a pilot shaft extending downwardly from said body and through said open channel defined in each of said first and second tracks of said grid track system, and means for connecting said pilot shafts to said at least one transfer unit to thereby support said at least one transfer unit in suspended relationship from said grid track system.

3. The automated material handling and storage system of claim 1 in which said at least one guide member includes at least one first guide member mounted to said at least one transfer unit and at least one second guide member mounted to said spreader beam, one of said first and second guide members being a fixed probe and the other including a telescoping probe receiver of a configuration to cooperatively receive said probe so as to prevent swaying or rotational movement of said spreader beam with respect to said transfer unit.

4. The automated material handling and storage system of claim 3 including at least two hoist assemblies mounted to said at least one transfer unit for controlling movement of said spreader beam, each hoist assembly including a pair of winding drums for controlling cables connected to said spreader frame, and at least one hoist motor drivingly connected to each hoist assembly.

5. The automated material handling and storage system of claim 3 wherein said at least one guide means includes a plurality of guide arms that extend downwardly from said at least one transfer unit for engaging said spreader beam as said spreader beam is raised above said plurality of cells.

6. The automated material handling and storage system of claim 5 wherein said guide arms are secured to said at least one transfer unit so as to engage with corners of said spreader beam, and each of said guide arms having two guide walls that are oriented approximately perpendicular relative to one another and which are flared outwardly at a lower portion thereof.

7. The automated material handling and storage system of claim 6 including two hoist assemblies mounted to said at least one transfer unit, each hoist assembly including a pair of winding drums for controlling cables connected to said spreader frame, and at least one hoist motor drivingly connected to each hoist assembly.

8. The automated material handling and storage system of claim 1 wherein said at least one transfer unit includes at least one first drive motor for driving said at least one transfer in a first direction along said first tracks and at least one second drive motor for driving said transfer units in a second direction along said second tracks.

9. The automated material handling and storage system of claim 8 wherein said at least one first drive motor drives a pair of first drive gears for engaging racks associated with said first tracks and said at least one second drive motor drives a pair of second drive gears for engaging racks associated with said second tracks.

10. The automated material handling and storage system of claim 9 including guide means positioned between each of said pair of first and second drive gears for cooperatively guiding said pair of first and second drive gears relative to said first and second rack members, and said first and second rack members being placed on opposite sides of an open channel defined by said first and second tracks of said grid track system.

11. The automated material handling and storage system of claim 10 wherein each carriage assembly includes a plurality of roller elements mounted to a body, each body being of a size to be cooperatively received within a channel defined by each of said first and second tracks of said grid track system, each of said carriages including a pilot shaft extending downwardly from said body and through said open channel defined in each of said first and second tracks of said grid track system, and means for connecting said pilot shafts to said at least one transfer unit to thereby support said at least one transfer unit in suspended relationship from said grid track system.

12. The automated material handling and storage system of claim 1 in which said means for providing energy includes a power raceway mounted adjacent said first and second tracks of said grid track system.

13. The automated material handling and storage system of claim 1 including a plurality of transfer units operatively mounted to said grid track system.

14. The automated material handling and storage system of claim 1 wherein said drive means includes first drive members for engaging said spaced and parallel first track members and second drive members for engaging said spaced and parallel second track members, and at least one first motor drivingly connected to said first drive members and at least one second motor drivingly connected to said second drive members.

15. The automated material handling and storage system of claim 1 wherein said at least one guide means includes a plurality of guide arms that extend downwardly from said at least one transfer unit for engaging said spreader beam as said spreader beam is raised above said plurality of cells.

16. The automated material handling and storage system of claim 1 wherein said first and second pairs of spaced parallel tracks consist of hollow beams having slots in the underside thereof which slots openly intersect with one another where said hollow beams intersect with one another, and at least four carriage means for supporting said at least one transfer unit to said hollow beams of said grid track system.

17. An automated material handling and storage system for storage and shipping containers, the system comprising, a structure defining a plurality of vertical cells, each cell having a plurality of tier levels and being of a size to cooperatively receive a storage and shipping container at each tier level, a grid track system mounted in spaced relationship above said plurality of vertical cells and having a plurality of first pairs of parallel tracks extending transversely with respect to and intersecting with a plurality of second pairs of parallel tracks in an X-Y pattern and which first and second tracks define openings at each intersection thereof, at least one transfer unit moveably mounted to the said grid track system so as to be suspended therefrom, said at least one transfer unit including a plurality of carriage means for suspending said at least one transfer unit from said grid track system so as to be selectively moveable along a pair of said plurality of first pairs of parallel tracks for movement in a first longitudinal direction directly above each of said plurality of said vertical cells and being selectively moveable along a pair of said plurality of second pairs of parallel tracks for movement in a second direction which is transverse to the first direction directly above each of said plurality of vertical cells, said at least one transfer unit including drive means for moving said at least one transfer unit along said grid track system so as to be moveable in a horizontal plane in both forward to back and side to side motions within the horizontal plane directly above said plurality of vertical cells, a spreader beam, hoist means carried by said at least one transfer unit for raising and lowering said spreader beam, said spreader beam being of a size to cooperatively engage a storage and shipping container within one of said cells, at least one guide member extending between said spreader beam and said at least one transfer unit to stabilize said spreader beam with respect to said transfer unit to thereby control movement of a storage and shipping container carried by said spreader beam when the storage and shipping container is elevated above said plurality of cells, and means for providing electrical power to said drive means of said at least one transfer unit, said grid track system including a plurality of rack members extending along each of said first and second tracks of the system, said drive means including at least one first and second drive motors which are powered by said means for providing electrical power to said drive means of said at least one transfer unit, said at least one first drive motor being drivingly connected to at least one first drive gear that is selectively engageable with said rack members of said first tracks and said at least one second drive motor being drivingly connected to at least one second drive gear that is selectively engageable with said rack members of said second tracks, and first means for selectively engaging and disengaging said at least one first drive gear with said rack members of said first tracks and second means for selectively engaging and disengaging said at least one second drive gear with said rack members of said second tracks.

18. The automated material handling and storage system of claim 17 wherein said at least one first drive gear is mounted to a first movable housing that is movable between a first position wherein said at least one first drive gear is spaced from said first rack members to a second position wherein said at least one first drive gear is in engagement with said first rack members, said at least one second drive gear being mounted to a second movable housing that is movable between a first position wherein said at least one second drive gear is spaced from said second rack members to a second position wherein said at least one second drive gear is in engagement with said second rack members, and means to lock said first and second movable housings in said second positions thereof.

19. An automated material handling and storage system for storage and shipping containers within a hold of a vessel, the system comprising, a structure defining a plurality of vertical cells that are arranged in side by side and end to end relationship relative to one another within the hold of the vessel, each of said cells defining a plurality of tier levels and being of a size to cooperatively receive a storage and shipping container at each of said plurality of tier levels, a grid track system mounted in spaced relationship above all of said cells and having a plurality of first spaced and parallel tracks that intersect transversely with a plurality of second spaced parallel tracks in an intersecting pattern, at least one transfer unit moveably suspended from said grid track system so as to be selectively moveable in either a first direction along pairs of spaced first parallel tracks or a second direction which is perpendicular to the first direction along pairs of spaced second parallel tracks in an X-Y motion directly above each of said plurality of cells, an arrangement of said grid track system being such that said at least one transfer unit is centered over a vertical cell when adjacent the intersections of said pairs of first and second parallel tracks and such that said at least one transfer unit is centered by being movable in either said first or second direction, said at least one transfer unit including a plurality of carriage means for suspending said at least one transfer unit from said grid track system, said at least one transfer unit including first drive means for moving said at least one transfer unit along said grid track system so as to be moveable in a horizontal plane in a forward to back motion and second drive means for moving in the horizontal plane in a side to side motion, a spreader beam, hoist means carried by said at least one transfer unit for raising and lowering said spreader beam by way of cable elements controlled by said hoist means, said spreader beam being of a size to cooperatively engage a storage and shipping container within one of said cells, said grid track system being mounted above said cells at a vertical height to permit movement of said at least one transfer unit and said spreader beam to which a storage and shipping container is secured, and a plurality of deck plates mounted above said grid track system and means for providing power to said at least one transfer unit.

20. The automated material handling and storage system for storage and shipping containers within a hold of a vessel of claim 19 including at least one first guide member extending from said spreader beam and cooperatively engaging at least one second guide member mounted to and extending from said at least one transfer unit, said first and second guide members being engageable with one another to stabilize said spreader beam with respect to said transfer unit to thereby control movement of a storage and shipping container carried by said spreader beam when the storage and shipping container is elevated above said plurality of cells.

21. The automated material handling and storage system for storage and shipping containers within a hold of a vessel of claim 19 wherein said first and second pairs of spaced parallel tracks consist of hollow beams having slots in the underside thereof which slots openly intersect with one another where said hollow beams intersect with one another, and at least four carriage means for supporting said at least one transfer unit to said hollow beams of said grid track system.

* * * * *